US008094097B2

(12) United States Patent
Kasai et al.

(10) Patent No.: US 8,094,097 B2
(45) Date of Patent: Jan. 10, 2012

(54) DATA LINE DRIVING CIRCUIT, ELECTRO-OPTICAL DEVICE, DATA LINE DRIVING METHOD, AND ELECTRONIC APPARATUS

(75) Inventors: Toshiyuki Kasai, Okaya (JP); Hiroaki Jo, Suwa (JP); Takeshi Nozawa, Suwa (JP); Hiroshi Horiuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 957 days.

(21) Appl. No.: 11/179,744

(22) Filed: Jul. 13, 2005

(65) Prior Publication Data

US 2006/0066538 A1 Mar. 30, 2006

(30) Foreign Application Priority Data

Sep. 30, 2004 (JP) ..... 2004-288693

(51) Int. Cl.
*G09G 3/30* (2006.01)

(52) U.S. Cl. ..... 345/77; 315/383

(58) Field of Classification Search ..... 345/36, 345/39, 45, 55, 76, 77, 89, 98, 605, 616, 345/690–692

See application file for complete search history.

(56) References Cited

U.S. PATENT DOCUMENTS

| | | | | | |
|---|---|---|---|---|---|
| 4,779,083 | A | * | 10/1988 | Ishii et al. | 345/692 |
| 5,029,105 | A | * | 7/1991 | Coleman et al. | 345/539 |
| 5,075,596 | A | * | 12/1991 | Young et al. | 315/169.3 |
| 5,534,883 | A | * | 7/1996 | Koh | 345/3.2 |
| 5,699,076 | A | * | 12/1997 | Tomiyasu | 345/103 |
| 5,745,061 | A | * | 4/1998 | Norsworthy et al. | 341/131 |
| 5,815,128 | A | * | 9/1998 | Hoshino et al. | 345/89 |
| 5,818,419 | A | * | 10/1998 | Tajima et al. | 345/691 |
| 6,064,359 | A | * | 5/2000 | Lin et al. | 345/89 |
| 6,081,274 | A | * | 6/2000 | Shiraishi | 345/426 |
| 6,166,751 | A | | 12/2000 | Yamada | |
| 6,239,781 | B1 | * | 5/2001 | Fujisawa | 345/691 |
| 6,323,880 | B1 | * | 11/2001 | Yamada | 345/690 |
| 6,414,661 | B1 | * | 7/2002 | Shen et al. | 345/82 |
| 6,518,941 | B1 | * | 2/2003 | Kimura | 345/55 |
| 6,552,701 | B1 | * | 4/2003 | Tanaka | 345/63 |
| 6,762,741 | B2 | * | 7/2004 | Weindorf | 345/102 |
| 2004/0150595 | A1 | | 8/2004 | Kasai | |
| 2004/0155875 | A1 | * | 8/2004 | Abe et al. | 345/211 |
| 2005/0046619 | A1 | * | 3/2005 | Senda et al. | 345/76 |

FOREIGN PATENT DOCUMENTS

| | | | |
|---|---|---|---|
| JP | 06-027440 | A | 2/1994 |
| JP | A-09-123524 | | 5/1997 |
| JP | A-09-330063 | | 12/1997 |
| JP | 2004-191752 | A | 7/2004 |

* cited by examiner

*Primary Examiner* — Amare Mengistu
*Assistant Examiner* — Vinh Lam
(74) *Attorney, Agent, or Firm* — Oliff & Berridge, PLC

(57) ABSTRACT

A data line driving circuit connected to data lines includes a bit shift unit that outputs input digital data composed of a plurality of bits for defining the brightness of pixels or bit-shifts the plurality of bits to lower levels to output them, based on a control signal, and a supply unit that supplies the output digital data of the bit shift unit to a D/A conversion unit. The D/A conversion unit supplies gray-scale signals obtained by D/A converting the output digital data of the supply unit to the data lines.

6 Claims, 10 Drawing Sheets

DATA LINE DRIVING CIRCUIT, ELECTRO-OPTICAL DEVICE, DATA LINE DRIVING METHOD, AND ELECTRONIC APPARATUS

BACKGROUND

The present invention relates to a data line driving circuit, an electro-optical device, a data line driving method, and an electronic apparatus.

The present invention relates to a data line driving circuit, an electro-optical device, a data line driving method, and an electronic apparatus.

In recent years, devices having organic light-emitting diode elements (hereinafter, referred to as OLED elements) have received attention as electro-optical devices to replace liquid crystal display devices. An OLED element electrically operates as a diode, and optically emits light when a forward bias current is applied so as to increase the emission brightness according to an increase in the forward bias current. In an electro-optical device having OLED elements, the OLED elements are arranged in a matrix to form a pixel region, and various images are displayed on the pixel region (for example, see Japanese Unexamined Patent Application Publication No. 2004-191752).

Further, a liquid crystal display device in which the brightness of a backlight is controlled according to the brightness of external light has been suggested. In this liquid crystal display device, when the brightness of external light is high, the brightness of the backlight increases up to a reference brightness. However, when the brightness of external light is low, the brightness of the backlight is reduced. In this way, the brightness of the backlight is controlled to the optimum level according to the brightness of external light, and the backlight is prevented from being used at the maximum brightness level, for example, in a dark place (for example, see Japanese Unexamined Patent Application Publication No. 6-27440).

However, in the electro-optical device having the OLED elements, since the OLED element emits light by itself, it is difficult to easily change the brightness without using the backlight.

SUMMARY

An advantage of the invention is that it provides a data line driving circuit capable of changing the brightness with a simple structure, an electro-optical device using the same, a data line driving method, and an electronic apparatus having the electro-optical device.

According to an aspect of the invention, a data line driving circuit connected to data lines includes a bit shift unit that outputs input digital data composed of a plurality of bits for defining the brightness of pixels or bit-shifts the plurality of bits to lower levels to output them, based on a control signal; and a supply unit that supplies the output digital data of the bit shift unit to a D/A conversion unit. In the data line driving circuit, the D/A conversion unit supplies gray-scale signals obtained by D/A converting the output digital data of the supply unit to the data lines.

In the above-mentioned structure, whether to output the input digital data as it is or to shift it to lower bit levels to output it is determined based on the control signal. When the input digital data is bit-shifted to the lower level, the brightness of the pixel defined by the input digital data becomes lower. Thus, it is possible to simply change the brightness.

Further, the supply unit is provided between the bit shift unit and the D/A conversion unit and includes electric wiring lines for transmitting the output digital data from the bit shift unit to the D/A conversion unit.

Furthermore, it is preferable that the data line driving circuit further include a pseudo-halftone processing unit which is provided between the bit shift unit and the supply unit to perform a pseudo-halftone process for pseudo-increasing the number of gray-scale levels on the output digital data of the bit shift unit.

According to the above-mentioned structure, although the number of gray-scale levels is reduced by the bit shift of the input digital data, the reduction in the number of gray-scale levels is compensated by the pseudo-halftone process, which makes it possible to prevent the deterioration of display quality.

The pseudo-halftone processing unit may perform the pseudo-halftone process on the input digital data using a dither method or error diffusion method. This pseudo-halftone process makes it possible to simply pseudo-increasing the number of gray-scale levels, and thus to obtain a high-quality display image.

Further, it is preferable that the data lines be composed of a plurality of wiring lines, that the D/A conversion unit includes a plurality of D/A conversion circuits corresponding to the plurality of wiring lines, and that the supply unit converts supplied digital data into a plurality of conversion data respectively corresponding to the plurality of D/A conversion circuits to output them to the D/A conversion unit.

According to the above-mentioned structure, when the input digital data is bit-shifted to the lower level by the bit shift unit, the gray-scale signals for lowering the brightness of the pixels are supplied to the plurality of wiring lines constituting the data lines, which causes the brightness of the pixels to be lowered. Also, the output digital data output by the bit shift unit, or the output digital data which has been subjected to the pseudo-halftone process is supplied to the supply unit, and the supply unit converts the supplied digital data and supplies them to the plurality of D/A conversion circuits, respectively. Therefore, the bit shift unit is not needed to be provided in correspondence to each D/A conversion circuit, but only one bit shift unit is needed. Thus, the circuit structure becomes simple, and power consumption can be reduced.

Further, according to another aspect of the invention, an electro-optical device includes the above-mentioned data line driving circuit and a control unit for supplying control signals to a bit shift unit.

According to this aspect, the control unit supplies the control signal to the bit shift unit, and bit-shifts the input data to the lower level to output it. Therefore, the brightness of the pixel defined by the input digital data is reduced, and thus the brightness can be simply changed.

Here, preferably, the electro-optical device further includes an external light brightness detecting unit for detecting the brightness of external light and for outputting it to the control unit, and the control unit supplies the control signal to the bit shift unit, based on the detection result of the brightness of external light. According to this structure, it is possible to perform brightness adjustment according to the brightness of external light. In particular, when the brightness of external light is low, the control unit bit-shifts the input digital data, which makes it possible to lower the brightness at a dark place.

Also, in the electro-optical device, it is preferable that the pixels each have three pixel circuits for emitting R, G, and B light components, and that the input digital data is composed of data indicating an R gray-scale level, data indicating a G gray-scale level, and data indicating a B gray-scale level.

According the above-mentioned structure, when the input digital data is bit-shifted by the bit shift unit, the data indicating the R gray-scale level, the data indicating the G gray-scale level, and the data indicating the B gray-scale level are bit-shifted, respectively. Accordingly, it is possible to reduce the brightness while maintaining the color balance, that is, without breaking the white balance.

Further, according to still another aspect of the invention, an electronic apparatus includes the above-mentioned electro-optical device. The electro-optical device can be applied, as display units, to various electronic apparatus, such as a personal computer, a cellular phone, a personal digital assistant, an electronic still camera, and an optical writing type printer and an electronic duplicating machine in which the electro-optical device is provided in a writing head.

Furthermore, according to yet another aspect of the invention, there is provided a data line driving method used for an electro-optical device including data lines, scanning lines, and pixel circuits respectively having electro-optical elements which are provided at intersections of the data lines and the scanning lines and whose brightness is controlled by a current supplied through the data lines. The data line driving method includes a process of outputting input digital data which is composed of a plurality of bits for defining the brightness of pixels, or of bit-shifting the plurality of bits to lower levels to output them, as output digital data, based on a control signal; and a process of supplying gray-scale signals obtained by D/A converting the output digital data to the data lines.

According to this structure, whether to output the input digital data as it is or to shift it to lower bit levels to output it is determined based on the control signal. When the input digital data is bit-shifted to the lower level, the brightness of the pixel defined by the input digital data becomes lower. Thus, it is possible to simply change the brightness.

Furthermore, it is preferable that a pseudo-halftone process for pseudo-increasing the number of gray-scale levels be performed on the output digital data to D/A convert them. According to this structure, although the number of gray-scale levels is reduced by the bit shift of the input digital data, the reduction in the number of gray-scale levels is compensated by the pseudo-halftone process. Thus, it is possible to prevent the deterioration of display quality.

Also, in the above-mentioned structure, it is preferable that the data lines be composed of a plurality of wiring lines, that the output digital data be converted into a plurality of conversion data corresponding to the plurality of wiring lines before the output digital data is D/A converted, and that the gray-scale signals obtained by D/A converting the conversion data be supplied to the plurality of data lines, respectively.

According to the above-mentioned structure, when the input digital data is bit-shifted to the lower level, the gray-scale signals for lowering the brightness of the pixels are supplied to the plurality of wiring lines constituting the data lines, respectively. Thus, it is possible to lower the brightness of the plurality of pixels.

Moreover, the electro-optical device means a device for displaying images using the light-emitting operation of the electro-optical elements. The electro-optical element is an element whose optical characteristics are changed by an electrical action, and includes, for example, a liquid crystal display element and an organic light-emitting diode.

BRIEF DESCRIPTION OF THE DRAWINGS

The invention will be described with reference to the accompanying drawings, wherein like numbers reference like elements, and wherein.

DETAILED DESCRIPTION OF EMBODIMENTS

First Embodiment

Figure 1:
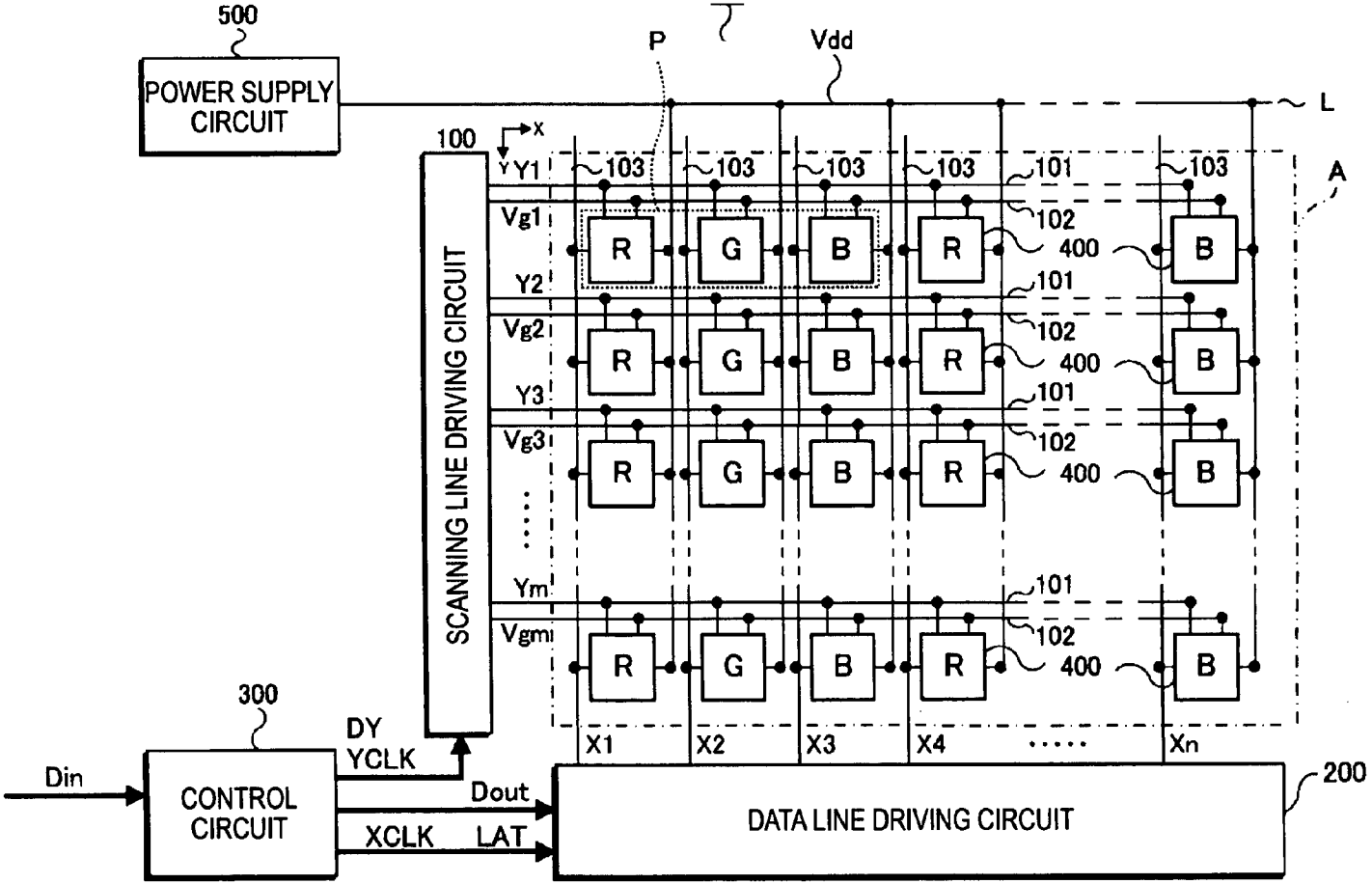
FIG. 1 is a block diagram showing the structure of an electro-optical device according to a first embodiment of the invention.

FIG. 1 is a block diagram schematically showing the structure of an electro-optical device 1 according to a first embodiment of the invention. The electro-optical device 1 has a pixel region A, a scanning line driving circuit 100, a data line driving circuit 200, a control circuit 300, and a power supply circuit 500. In the pixel region A, m scanning lines 101 and m light-emission control lines 102 are formed parallel to the X direction. Also, n data lines 103 are formed parallel to the Y direction perpendicular to the X direction. Further, pixel circuits 400 are provided at intersections of the scanning lines 101 and the data lines 103, respectively. Each pixel circuit 400 includes an OLED element which emits a light component corresponding to any one of the three primary colors R, G, and B. Also, one pixel unit P corresponding to a pixel of an image (hereinafter, simply referred to as a pixel P) is formed by three pixel circuits 400 for respectively emitting R, G, and B light components, and the pixels P are arranged in the direction in which the data lines 103 extend. Each of the pixel circuits 400 is supplied with a power supply voltage Vdd through a power supply line L.

Figure 2:
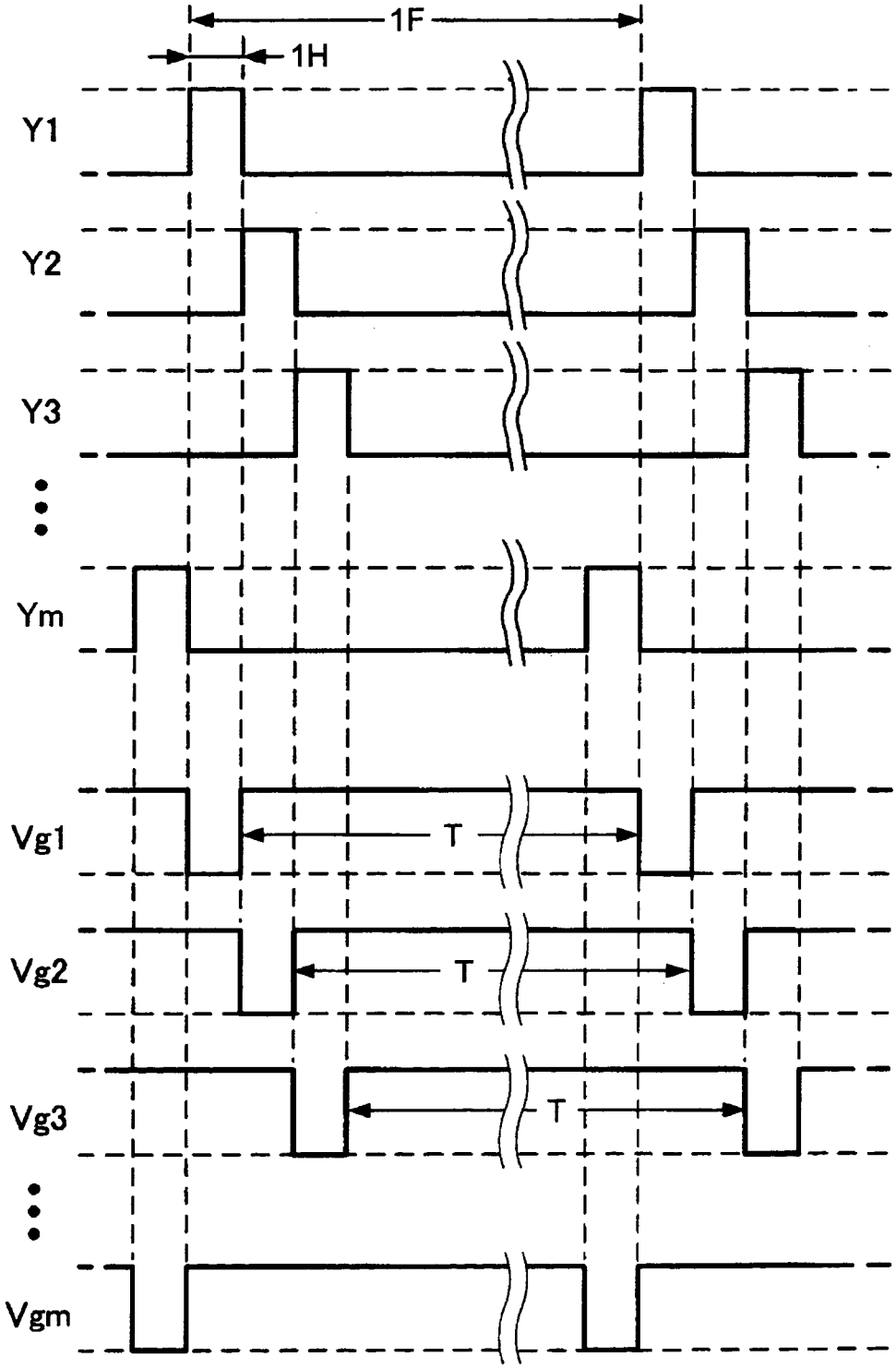
FIG. 2 is a timing chart for a scanning line driving circuit in the electro-optical device.

The scanning line driving circuit 100 generates scanning signals Y1, Y2, Y3, . . . , Ym for sequentially selecting the plurality of scanning lines 101, and generates light-emission control signals Vg1. Vg2, Vg3, . . . , Vgm. The scanning signals Y1 to Ym and the light-emission control signals Vg1 to Vgm are generated by sequentially transmitting a Y transmission start pulse DY in synchronization with a Y clock signal YCLK. The light-emission control signals Vg1, Vg2, Vg3, . . . , Vgm are supplied to the pixel circuits 400 through the light-emission control lines 102, respectively. FIG. 2 shows an example of a timing chart for the scanning signals Y1 to Ym and the light-emission control signals Vg1 to Vgm. The scanning signal Y1 is a pulse having a width corresponding to one horizontal scanning period 1H at an initial timing of one vertical scanning period 1F, and is supplied to a first scanning line 101. Then, this pulse is sequentially shifted, and is then supplied to second, third, . . . , m-th scanning lines 101 as the scanning signals Y2, Y3, . . . , Ym, respectively. Generally, when the scanning signal Yi supplied to an i-th scanning line 101 (where i is an integer satisfying $1 \leqq i \leqq m$) turns to an H level, the corresponding scanning line 101 is selected. Also, for example, signals obtained by inverting the logical levels of the scanning signals Y1, Y2, Y3, . . . , Ym are used as the light-emission control signals Vg1, Vg2, Vg3, . . . , Vgm.

The data line driving circuit 200 supplies gray-scale signals X1, X2, X3, . . . , Xn to the pixel circuits 400 corresponding to the selected scanning lines 101, based on an output gray-scale data Dout. In this example, the gray-scale signals X1 to Xn are applied as current signals indicating gray-scale levels.

The control circuit 300 generates various control signals, such as the Y clock signal YCLK, an X clock signal XCLK, a horizontal scanning period signal LAT, and the Y transmission start pulse DY, and outputs them to the scanning line driving circuit 100 and the data line driving circuit 200. Among them, the horizontal scanning period signal LAT indicates one horizontal scanning period 1H, and is output to the data line driving circuit 200. The control circuit 300 performs image processing, such as gamma correction, on an input gray-scale data Din supplied from the outside to generate the output gray-scale data Dout.

Figure 3:
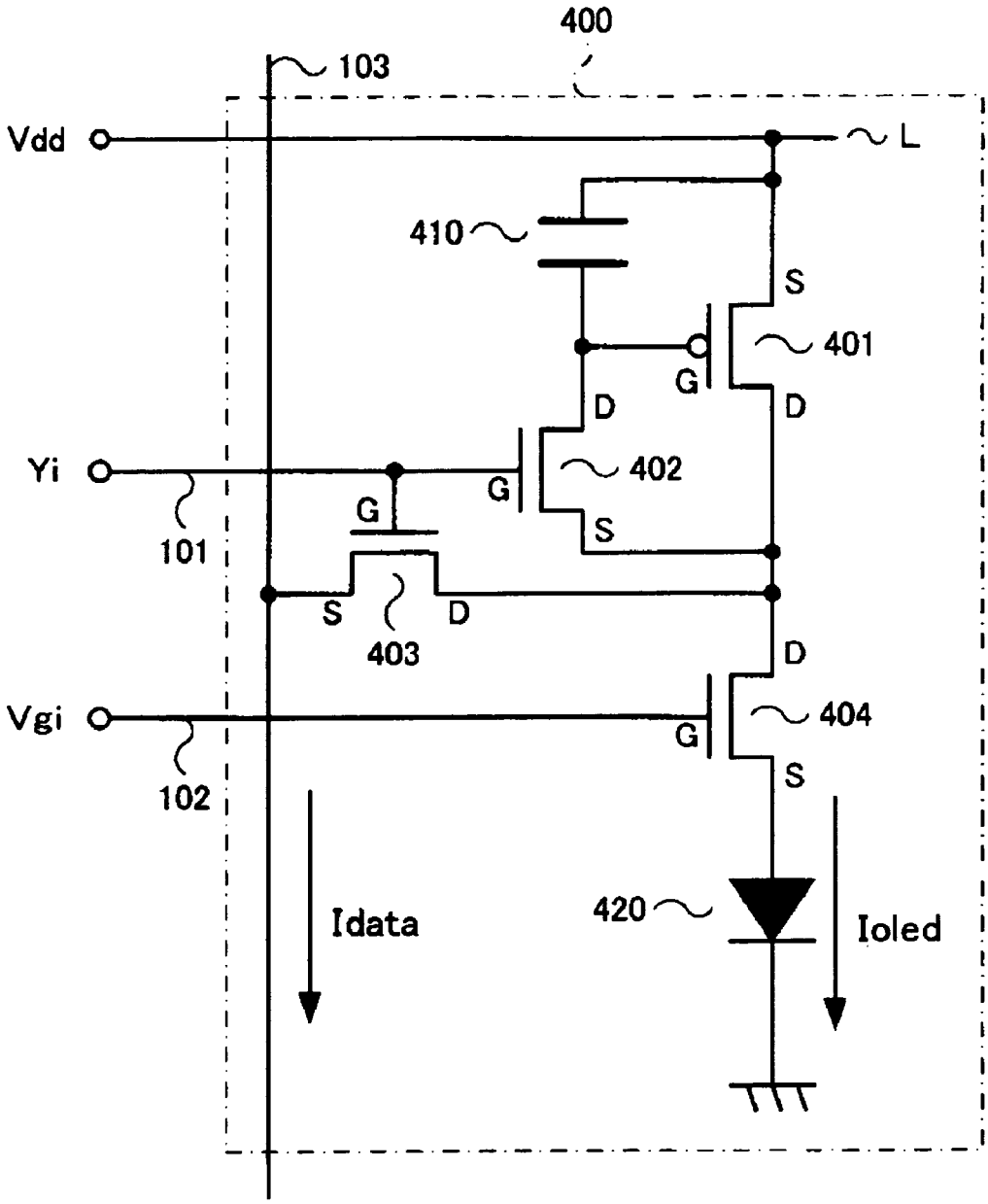
FIG. 3 is a circuit diagram showing the structure of a pixel circuit in the electro-optical device.

Next, the pixel circuit 400 will be described. FIG. 3 is a circuit diagram of the pixel circuit 400. The pixel circuit 400 shown in FIG. 3 corresponds to an i-th row and is supplied with the power supply voltage Vdd. The pixel circuit 400 includes four TFTs 401 to 404, a capacitive element 410, and an OLED element 420. In a process of manufacturing the TFTs 401 to 404, a polysilicon layer is formed on a glass substrates using laser annealing. Also, a light-emitting layer of the OLED element 420 is interposed between an anode and a cathode. Further, the OLED element 420 emits light with a brightness corresponding to a forward bias current. The light-emitting layer is made of an organic electro-luminescent (EL) material corresponding to an emission color. In a process of manufacturing the light-emitting layer, the organic EL material is discharged from an inkjet head as liquid droplets by an inkjet method and is then dried.

The TFT 401, which is a driving transistor, is of a p-channel type, and the TFTs 402 to 404, which are switching transistors, are of an n-channel type. A source electrode of the TFT 401 is connected to the power supply line L, and a drain electrode thereof is connected to a drain electrode of the TFT 403, a drain electrode of the TFT 404, and a source electrode of the TFT 402.

One end of the capacitive element 410 is connected to the source electrode of the TFT 401, and the other end thereof is connected to a gate electrode of the TFT 401 and a drain electrode of the TFT 402. A gate electrode of the TFT 403 is connected to the scanning line 101, and a source electrode thereof is connected to the data line 103. Also, a gate electrode of the TFT 402 is connected to the scanning line 101. In addition, a gate electrode of the TFT 404 is connected to the light-emission control line 102, and a source electrode thereof is connected to the anode of the OLED element 420. The gate electrode of the TFT 404 is supplied with a light-emission control signal Vgi through the light-emission control line 102. Also, the cathode of the OLED element 420 is a common electrode to all pixel circuits 400, and a low (reference) potential of the power supply is applied thereto.

In this structure, if the scanning signal Yi turns to the H level, the n-channel TFT 402 is turned on, and then the gate electrode and the drain electrode of the TFT 401 are connected to each other, so that the TFT 401 functions as a diode. If the scanning signal Yi turns to the H level, the n-channel TFT 403 is also turned on, similar to the TFT 402. As a result, a current Idata of the data line driving circuit 200 flows in the path of the power supply line L, the TFT 401, the TFT 403, and the data line 103. In this case, charges corresponding to the potential of the gate electrode of the TFT 401 are stored in the capacitive element 410.

If the scanning signal Yi turns to an L level, the TFTs 403 and 402 are turned off. At this time, since the input impedance of the gate electrode of the TFT 401 is very high, the storage state of charge in the capacitive element 410 is not changed. A voltage between the gate and the source of the TFT 401 is held at a voltage when the current Idata flows. Also, if the scanning signal Y1 turns to the L level, the light-emission control signal Vgi turns to an H level. Thereby, the TFT 404 is turned on, and thus an injection current Ioled corresponding to the gate voltage flows between the source and the drain of the TFT 401. Specifically, this current flows in the path of the power supply line L, the TFT 401, the TFT 404, and the OLED element 420.

Here, the injection current Ioled flowing through the OLED element 420 is determined by the voltage between the gate and the source of the TFT 401 which is held by the capacitive element 410 when the current Idata flows through the data line 103 by the scanning signal Yi having the H level. Therefore, when the light-emission control signal Vgi turns to the H level, the injection current Ioled flowing through the OLED element 420 is approximately equal to the previous current Idata. Since the pixel circuit 400 controls emission brightness by the current Idata, it is a current programming circuit. Also, the pixel circuit 400 may be composed of a voltage programming circuit or a PWM (pulse width modulation) circuit.

Figure 4:
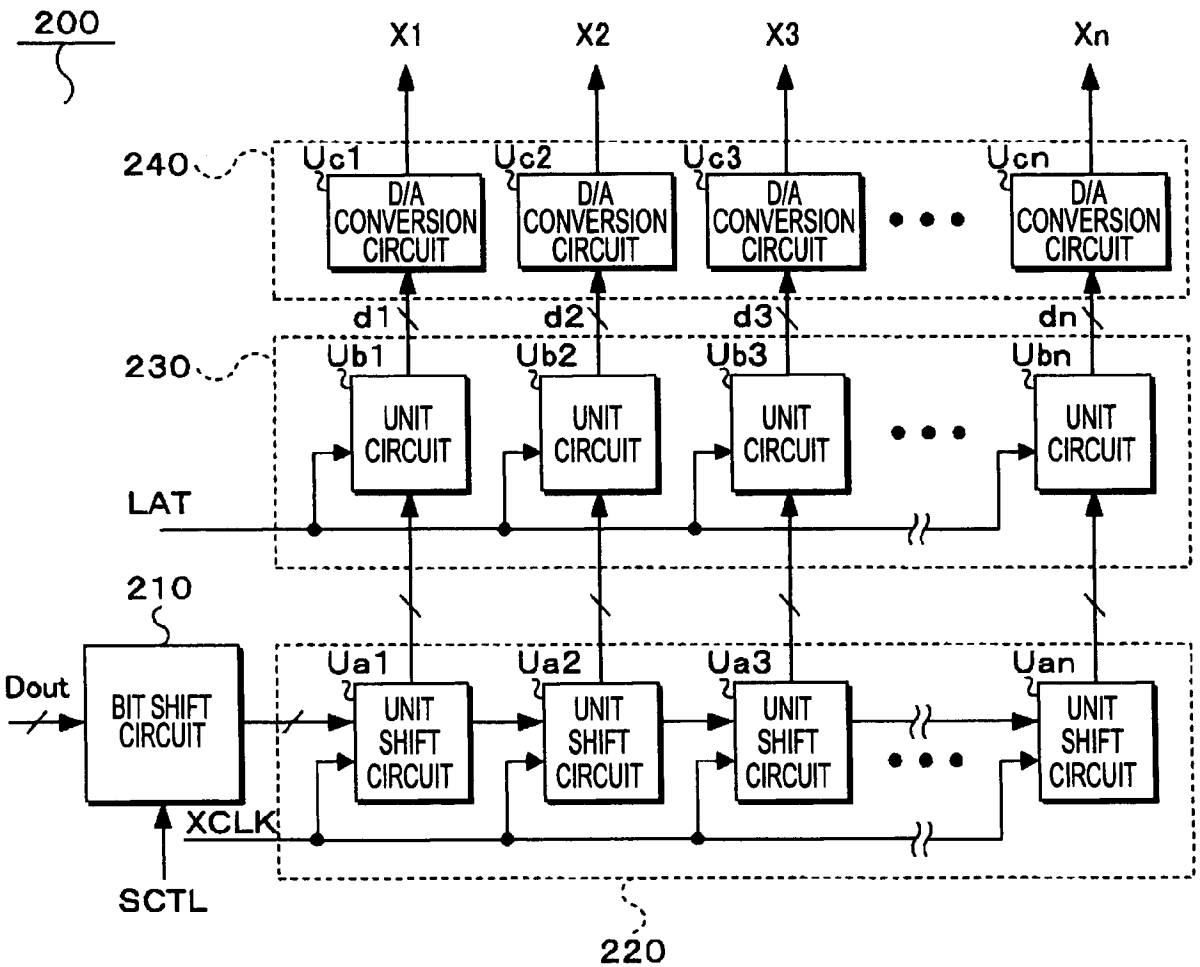
FIG. 4 is a block diagram showing the structure of a data line driving circuit in the electro-optical device.

FIG. 4 is a block diagram showing the detailed structure of the data line driving circuit 200. The data line driving circuit 200 has a bit shift circuit 210, a shift register 220, a latch circuit 230, and a D/A conversion unit 240. The bit shift circuit 210 outputs the output gray-scale data Dout having a digital signal format to the shift register 220. Also, the bit shift circuit 210 shifts the output gray-scale data Dout to a lower bit, and outputs it to the shift register 220 when a shift command signal SCTL is input from the control circuit 300.

Figure 5:
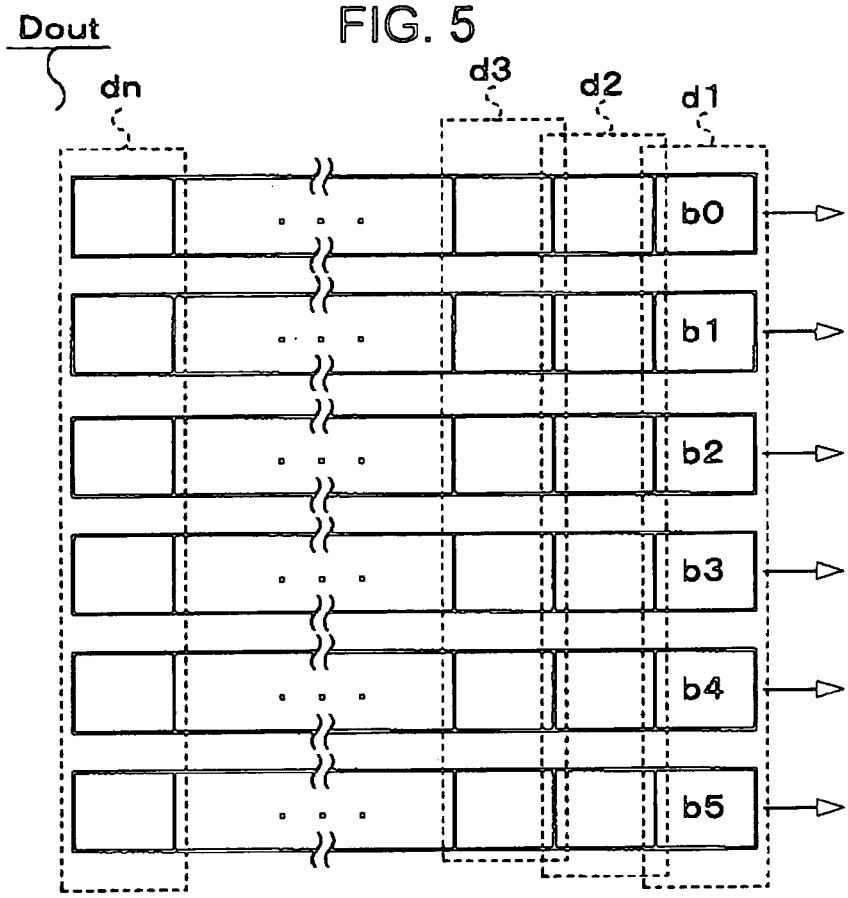
FIG. 5 is a view schematically showing output gray-scale data in the electro-optical device.
Figure 6:
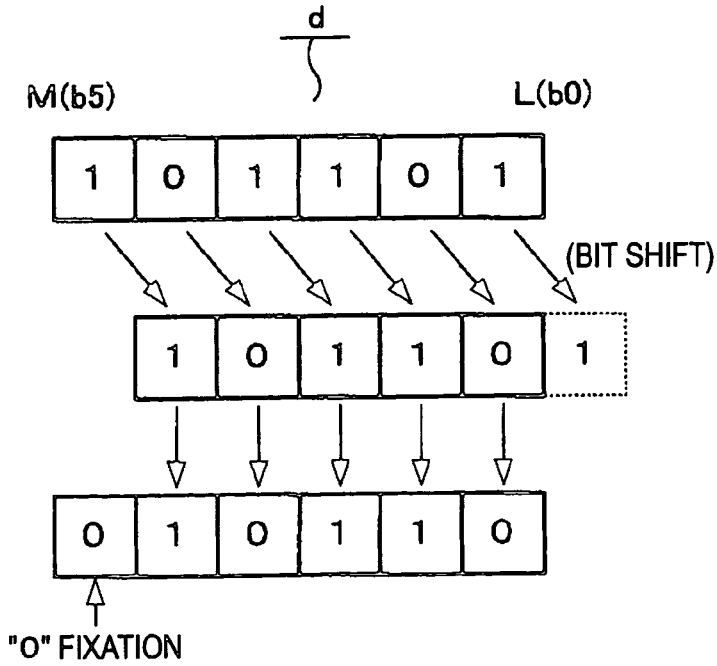
FIG. 6 is a view showing the bit shift of the output gray-scale data.

As mentioned above, the output gray-scale data Dout is digital data in which gray-scale data d is a continuous series of data corresponding to the number of pixel circuits 400 (in this embodiment, n which is the same number as that of the data lines 103) connected to one scanning line 101, as shown in FIG. 5. The gray-scale data d is digital data having 6 parallel bits b0 to b5 and controls the emission brightness of the pixel circuit 400 by these bits b0 to b5. When the output gray-scale data Dout is bit-shifted, the bit shift circuit 210 shifts 6-bit gray-scale data d to the lower level by one bit to remove a least significant bit L, and to fix the bit value of an empty most significant bit M to '0' (L level), as shown in FIG. 6. As a result, the digital value of the gray-scale data d becomes half the original value. The bit shift circuit 210 repeatedly performs this operation for every gray-scale data d included in the output gray-scale data Dout to bit-shift the output gray-scale data Dout. Accordingly, when the bit shift circuit 210 bit-shifts the output gray-scale data Dout, every gray-scale data d included in the output gray-scale data Dout becomes half the original value.

The shift register 220 has n unit shift circuits Ua1 to Uan respectively provided in correspondence to n data lines 103. The shift register 220 sequentially transmits the output gray-scale data Dout between the n unit shift circuits Ua1 to Uan in synchronization with the X clock signal XCLK to generate dot-sequential data signals. The latch circuit 230 has n unit circuits Ub1 to Ubn respectively provided in correspondence to the n unit shift circuits Ua1 to Uan. The latch circuit 230 latches the dot-sequential data signals with the latch signal LAT synchronized with the horizontal scanning synchronizing signal, and converts them into line-sequential gray-scale data d1 to dn. These gray-scale data d1 to dn are supplied to the D/A conversion unit 240.

Figure 7A:
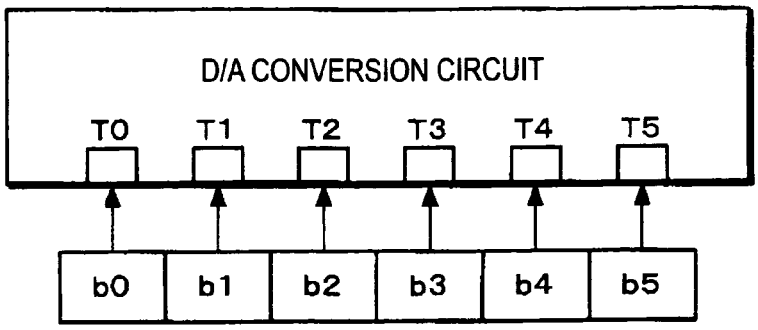
FIG. 7A is a view showing the input of the gray-scale data to a D/A conversion circuit in the electro-optical device when the pixel circuit emits light with general brightness.

The D/A conversion unit 240 has n D/A conversion circuits Uc1 to Ucn. The n D/A conversion circuits Uc1 to Ucn are respectively provided in correspondence to the n data lines 103, and convert the gray-scale data d1, d2, . . . , dn from digital signals to analog signals to output them to the data lines 103 as gray-scale signals X1 to Xn. Specifically, as shown in FIG. 7A, the D/A conversion circuit Uc has six input terminals T0 to T5 respectively provided in correspondence to the bits b0 to b5 of the gray-scale data d. That is, the least significant bit b0 among the gray-scale data d is input to the input terminal T0, and the most significant bit b5 is input to the input terminal T5.

Figure 8:
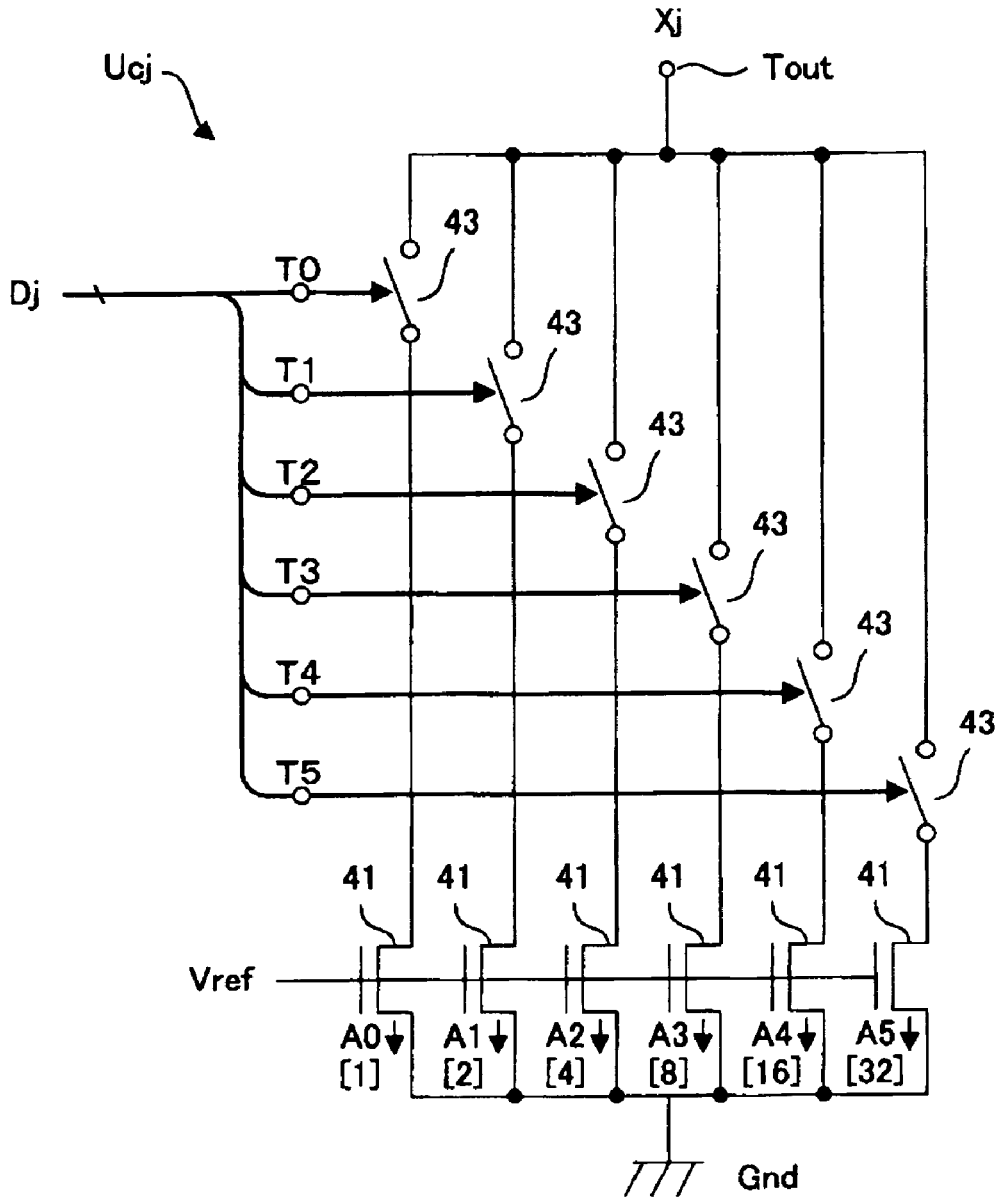
FIG. 8 is a circuit diagram of the D/A conversion circuit in the electro-optical device.

FIG. 8 is a circuit diagram of the D/A conversion circuit Ucj, where j is an integer satisfying $1 \leqq j \leqq n$. As shown in FIG. 8, the D/A conversion circuit Ucj has six transistors 41 corresponding to the respective bits of the gray-scale data dj and switches 43 respectively connected to the drain electrodes of the transistors 41. The source electrode of each transistor 41 is grounded. Also, the gate electrodes of all the transistors 41 have a predetermined reference voltage Vref applied thereto. The characteristics (particularly, a threshold voltage) of the transistors 41 are selected such that each of the currents A0 to A5 flowing through the transistors 41 when the common reference voltage Vref is applied to the gate electrodes has a magnitude obtained by weighting by the n-th power of 2. More specifically, as shown in FIG. 8, the ratio of the currents A0 to A7 flowing through the respective transistors 41 in the first state to the eighth state is A0:A1:A2:A3:A4:A5=1:2:4:8:16:32. That is, these transistors 41 function as current sources for generating the plurality of currents A0 to A7 to which different weight values are assigned, respectively.

Meanwhile, an end of each of the switches 43 opposite to the transistor 41 is commonly connected to the terminal T0 to which the gray-scale signal Xj is output. Each switch 43 is selectively switched in response to the bit corresponding to the switch 43 among the gray-scale data dj. For example, the first switch 43 is turned on if the least significant bit of the gray-scale data dj is '1', but is turned off if the least significant bit is '0'. In this structure, if at least one switch 43 among the six switches 43 is turned on in response to the gray-scale data dj, the current flows through at least one transistor 41 corresponding to the switch 43, and the current signal obtained by adding the currents is supplied to the output terminal Tout as the gray-scale signal Xj. The gray-scale signal Xj flows through the data line 103 as the current Idata, and then the pixel circuit 400 emits light with the brightness corresponding to the value of the current Idata. That is, the pixel circuit 400 emits light with the brightness corresponding to the digital value of the gray-scale data dj.

Figure 7B:
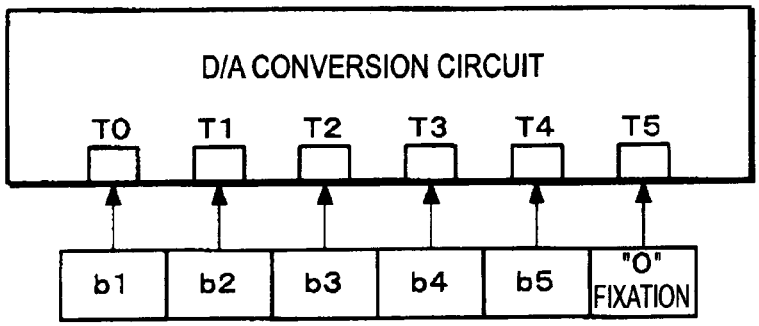
FIG. 7B is a view showing the input of the gray-scale data to the D/A conversion circuit in the electro-optical device when the pixel circuit emits light with low brightness.

Here, as shown in FIG. 7B, if the output gray-scale data Dout is bit-shifted by the bit shift circuit 210, the bits b1 to b5 among the bits b0 to b5 of the gray-scale data d output from the control circuit 300 are input to the terminals T0 to T4 of the D/A conversion circuit Uc, respectively, and the bit value input to the terminal T5 becomes '0' (L level). That is, since the digital value of the output gray-scale data Dout input to the D/A conversion circuit Uc becomes half the original value output from the control circuit 300, the D/A conversion circuit Uc generates a gray-scale signal X whose current value is reduced by half. The gray-scale signal X is supplied to the pixel circuit 400 through the data line 103, and then the pixel circuit 400 emits light with half of the brightness prescribed by the gray-scale data d from the control circuit 300.

At this time, since the bit shift circuit 210 reduces the digital values of all gray-scale data d1, d2, . . . , dn included in the output gray-scale data Dout by half, all the n D/A conversion circuits Uc1 to Ucn reduce the current values of the gray-scale signals X1 to Xn by half. Accordingly, the n pixel circuits 400 connected to one scanning line 101 all emit light with half of the brightness prescribed by the original output gray-scale data Dout output from the control circuit 300. As a result, the brightness of the entire pixel region A is uniformly reduced.

As such, the data line driving circuit 200 of the present embodiment bit-shifts the output gray-scale data Dout, which is a digital signal, by the bit shift circuit 210 to decrease each digital value of the gray-scale data, and inputs them to the D/A conversion unit 240. Then, since the current values of the gray-scale signals X1 to Xn generated by the D/A conversion unit 240 are decreased uniformly, the emission brightness of each pixel circuit 400 indicated by the output gray-scale data Dout can be uniformly reduced.

Furthermore, the emission brightness of each pixel circuit 400 is more uniformly reduced than the emission brightness indicated by the output gray-scale data Dout. Therefore, the emission brightness is reduced while the color balance of the entire pixel region A is being maintained although the R, G, and B pixel circuits 400 have different characteristics, as in the electro-optical device 1 according to this embodiment. Thus, the white balance is maintained. Accordingly, for example, in the case in which the brightness of external light is lower (particularly, when the brightness is smaller than a predetermined threshold value), when the control circuit 300 outputs the shift command signal SCTL to the data line driving circuit 200, the brightness of the entire the pixel region A is uniformly reduced by the bit shift of the output gray-scale data Dout by the bit shift circuit 210. Accordingly, the brightness control of the pixel region A corresponding to the brightness of external light can be simply performed while maintaining the white balance. Therefore, when the circumference luminance is as high as daylight, the pixel circuit 400 emits light with general brightness. When the circumference luminance is as low as nighttime, the pixel circuit 400 emits light with low brightness.

Also, by providing only the bit shift circuit 210 for bit-shifting the output gray-scale data Dout to the data line driving circuit 200, the brightness of the pixel circuit 400 can be reduced, without significantly changing the structure of the data line driving circuit 200 and without significantly increasing the size of a circuit. Further, the number of effective bits of the output gray-scale data Dout is reduced by the bit shift circuit 210, and the output gray-scale data Dout is input to the D/A conversion unit 240. Therefore, if a test signal having a bit number smaller than a predetermined bit number (6 bits in the present embodiment) of the output gray-scale data Dout is input to the data line driving circuit 200 to perform an operational test of the pixel region A, the number of connecting pins of the test circuit can be reduced.

In the present embodiment, the bit shift circuit 210 bits-shifts the output gray-scale data Dout to the lower level by one bit. However, the bit shift circuit 200 may bit-shift the data to the lower level by two or more bits. By increasing the number of bits to be shifted, the emission brightness of the pixel circuit 400, that is, the brightness of the entire pixel region A can be reduced in proportion to the second power of the number of bits.

Second Embodiment

Next, a second embodiment of the invention will be described. An electro-optical device according to the second embodiment is different from the electro-optical device according to the first embodiment in that, in order to compensate for a reduction in the number of gray-scale levels, a dither process for pseudo-increasing the number of gray-scale levels is performed on the output gray-scale data Dout, and then the output gray-scale data is supplied to the shift register 220, when the output gray-scale data Dout is bit-shifted by the bit shift circuit 210 to reduce the efficient number of bits for prescribing the number of gray-scale levels. Specifically, the electro-optical device of the second embodiment is different from the electro-optical device of the first embodiment in the detailed structure of the data line driving circuit 200, and the other structures thereof are the same as those of the electro-optical device of the first embodiment.

Figure 9:
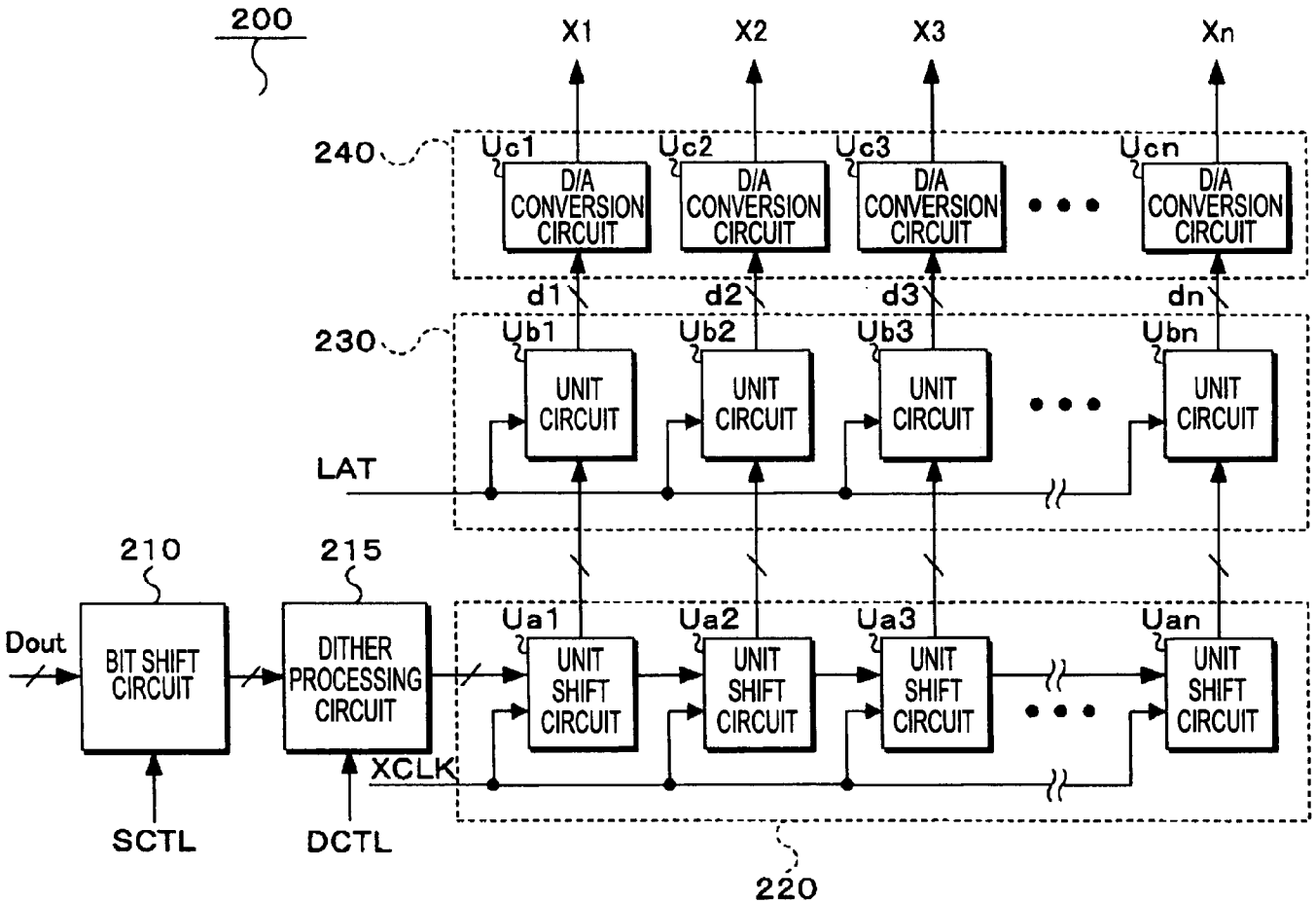
FIG. 9 is a block diagram of a data line driving circuit used for an electro-optical device according to a second embodiment.

FIG. 9 is a block diagram of a data line driving circuit 200 of the second embodiment. As shown in FIG. 9, the data line driving circuit 200 of the second embodiment includes a dither processing circuit 215 provided between a bit shift circuit 210 and a shift register 220. When a dither command signal DCTL is input from the control circuit 300, the dither processing circuit 215 performs the dither process on the output gray-scale data Dout input from the bit shift circuit 210 according to a dither method and then outputs it to the shift register 220.

Here, the dither process is a kind of pseudo-halftone process for increasing the number of gray-scale levels by the pseudo-halftone, and represents a pseudo-halftone by comparing the level of the input pixel with a different threshold value for each pixel. The input pixel corresponds to the threshold value one to one. More specifically, the threshold value prescribed by a dither matrix is compared with the output gray-scale data Dout.

The control circuit 300 also outputs the dither command signal DCTL to the dither processing circuit 215 when outputting the shift command signal SCTL to the bit shift circuit 210. That is, when the output gray-scale data Dout is bit-shifted, the dither process is always performed on the bit-shifted output gray-scale data Dout.

In order to compensate for a reduction in the number of gray-scale levels due to the reduction in the efficient number of bit by the bit shift of the output gray-scale data Dout, the dither processing circuit 215 changes the light-emission display color of the pixel P composed of three pixel circuits 400 for displaying three primary colors R, G, and B according to the middle gray-scale level color to be displayed for each pixel P.

In the present embodiment, when the output gray-scale data Dout is bit-shifted by the bit shift circuit 210 to reduce the efficient number of bits, in order to compensate for the reduction in the number of gray-scale levels due to the reduction in the efficient number of bits, the dither process is performed on the output gray-scale data Dout by the dither processing circuit 215, and the processed output gray-scale data is supplied to the shift register 220. Therefore, although the number of gray-scale levels is reduced by the bit shift of the output gray-scale data Dout, the number of gray-scale levels is pseudo-compensated by the dither process. Thus, the reduction in the number of gray-scale levels is not perceived, and display quality can be maintained. Also, since the dither processing circuit 215 performs the dither process only using the efficient number of bits of the bit-shifted output gray-scale data Dout, the emission brightness of the entire pixel region A is uniformly maintained at a low level, and thus it is possible to compensate for the reduction in the number of gray-scale levels while maintaining the white balance.

Further, in the present embodiment, the reduction in the number of gray-scale levels due to the bit shift of the output gray-scale data Dout is compensated by the dither process. However, the process for compensation is not limited to the dither process. That is, any pseudo-halftone process for pseudo-increasing the number of gray-scale levels may be used as the process. For example, an error diffusion process may be used. The error diffusion process distributes errors (a difference between original density and binary image density) generated upon binary-coding to the peripheral pixels to maintain the density.

Modifications

The invention is not limited to the above-mentioned embodiments, but can be applied to the following various modifications.

(1) In the first and second embodiments, the power supply circuit 500 may have a function for reducing the voltage value of the power supply voltage Vdd supplied through the power supply line L when the brightness of the pixel circuit 400 is reduced. More specifically, when the brightness of the pixel circuit 400 is lowered, the current flowing through the OLED element 420 becomes small. Therefore, the voltage value of the power supply voltage Vdd supplied by the power supply circuit 500 may be lower than a voltage value (for example, 20 V) when the pixel circuit 400 emits light with general brightness. For example, when the control circuit 300 outputs the shift command signal SCTL to the bit shift circuit 210 to reduce the brightness of the pixel circuit 400, the command signal for reducing the voltage value is also output to the power supply circuit 500. When the power supply circuit 500 receives this command signal, it decreases the voltage value of the power supply voltage Vdd to output a lower voltage (for example, 10 V). Thereby, since the voltage value of the power supply voltage Vdd and the brightness of the pixel circuit 400 are reduced, unnecessary power consumption when the pixel circuit 400 emits light with low brightness is suppressed, and thus power consumption can be reduced.

(2) In the first and second embodiment, the control circuit 300 may a function for adjusting the time when the light-emission control signal Vg of the pixel circuit 400 turns to an H level (hereinafter, referred to as light-emission duty) to minutely adjust the brightness of the entire pixel region A. More specifically, when the output gray-scale data Dout is bit-shifted by Z bits, the brightness of the pixel circuit 400 becomes $1/2^Z$, and thus the brightness is reduced by $1/2^Z$. Therefore, for example, the control circuit 300 changes the pulse width of the X clock signal XCLK to adjust the light-emission duty of the pixel circuit 400, so that the brightness of the pixel circuit 400 is minutely adjusted. Therefore, it is possible to change the brightness to a value of 1/3 or 1/6 other than $1/2^Z$.

(3) As the OLED element included in the pixel circuit 400 of the first and second embodiments, an OLED element using an organic EL material, such as a low molecule, a high molecule, or dendrimer, can be used. Also, the pixel circuit 400 may include a self-emission device, such as a field emission device (FED), a surface-conduction emission device (SED), a ballistic electron emission device (BSD), or a light emitting diode, instead of the OLED element.

(4) Although the electro-optical device 1 having the pixel region A in which the pixels each including the OLED elements are arranged is given as an illustrative example in the first and second embodiments, the structure of the pixel P or the pixel region A may be arbitrarily changed. The invention can be applied to, for example, display devices having various display panels, such as a liquid crystal display panel, a field emission display panel, and a plasma display panel, as the pixel region A. Accordingly, the pixel P of the invention may be an element, which is a unit for displaying the gray-scale level specified by the image data, and the detailed structure thereof does not matter. Typically, a device including an electro-optical element having a property in which optical characteristics, such as transmittance and brightness, are changed when electrical energy is applied is employed as the pixel P.

Applications

Figure 10:
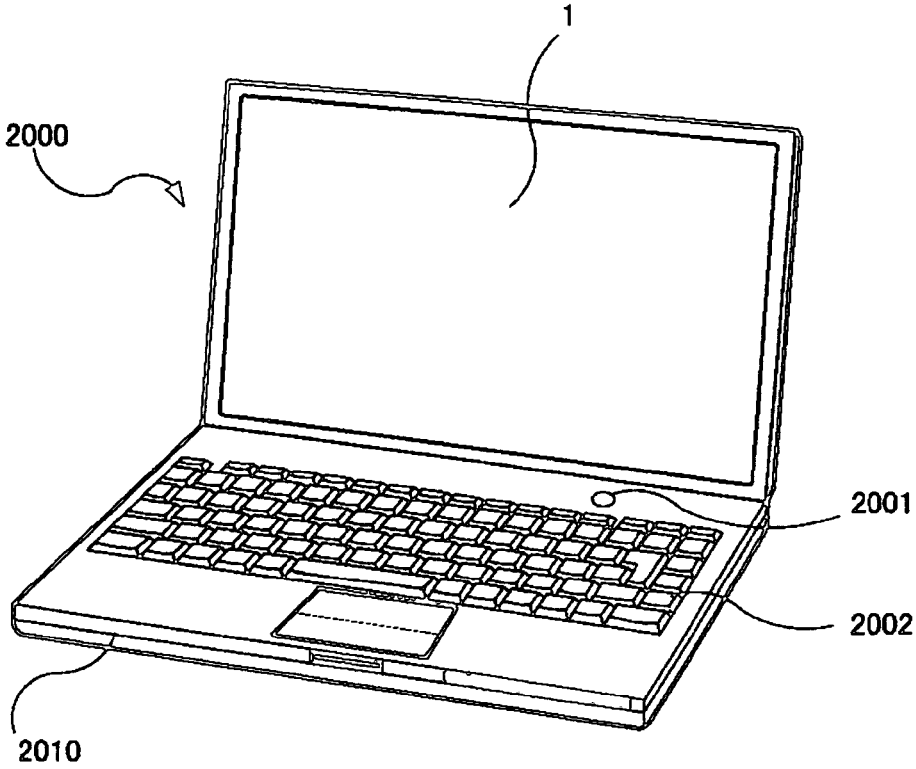
FIG. 10 is a perspective view showing the structure of a mobile personal computer equipped with the electro-optical device.

Next, an electronic apparatus to which the electro-optical device 1 according to the above-mentioned embodiments and modifications is applied will be explained. FIG. 10 shows the structure of a mobile personal computer including the electro-optical device 1. A personal computer 2000 has the electro-optical device 1, serving as a display unit, and a main body 2010. The main body 2010 is provided with a power supply switch 2001 and a keyboard 2002. Since the electro-optical device uses the OLED elements 420, an image can be displayed on a screen at the wide viewing angle.

Figure 11:
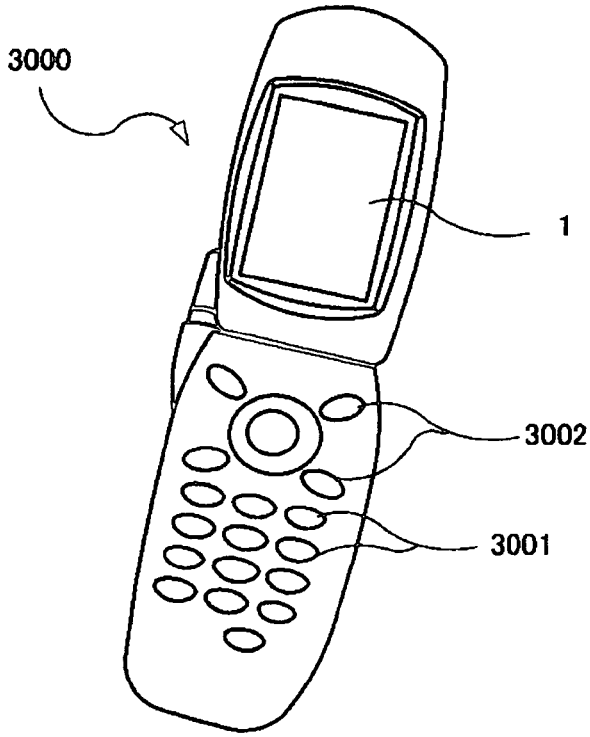
FIG. 11 is a perspective view showing the structure of a cellular phone equipped with the electro-optical device.

FIG. 11 shows the structure of a cellular phone including the electro-optical device 1. A cellular phone 3000 includes a plurality of operation buttons 3001, a scroll button 3002, and the electro-optical device 1, serving as a display unit. By operating the scroll button 3002, the screen displayed in the electro-optical device 1 is scrolled.

Figure 12:
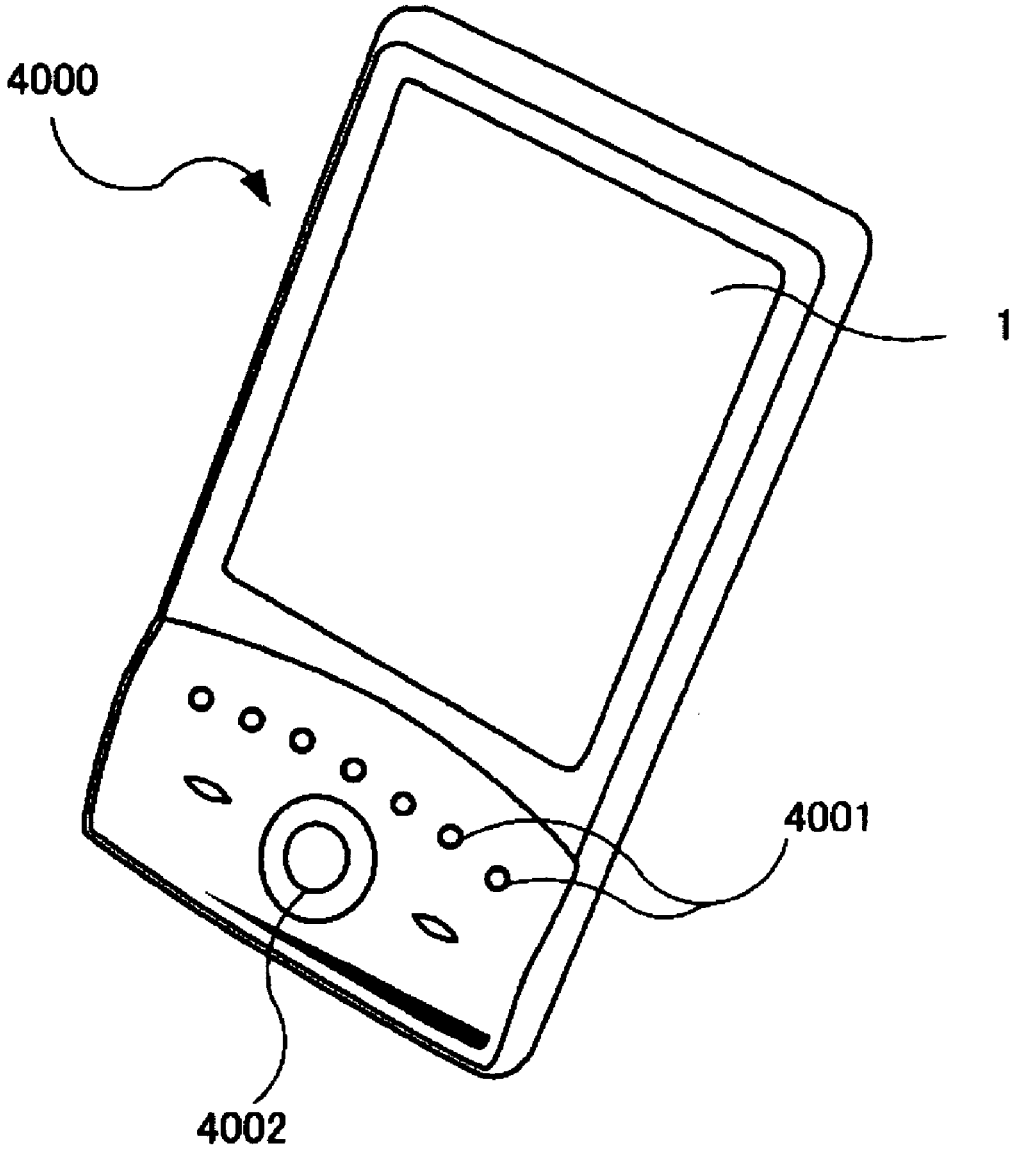
FIG. 12 is a perspective view showing the structure of a personal digital assistant equipped with the electro-optical device.

FIG. 12 shows the structure of a personal digital assistant (PDA) including the electro-optical device 1. A personal digital assistant 4000 includes a plurality of operation buttons 4001, a power supply switch 4002, and the electro-optical device 1, serving as a display unit. By operating the power supply switch 4002, various kinds of information items, such as an address book and a schedule book, are displayed on the electro-optical device 1.

Further, electronic apparatuses including the electro-optical device 1 include, in addition to the electronic apparatuses shown in FIGS. 9 to 11, a flat-display-type large-screen television, such as a liquid crystal TV, a display and illumination apparatus, a game machine, an electronic paper, a video camera, a digital camera, a car navigation apparatus, a car stereo, an operating panel, a printer, a scanner, a duplicating machine, a video player, a pager, an electronic organizer, an electronic calculator, a word processor, a viewfinder or monitor-direct-view-type videotape recorder, a workstation, a television phone, a POS terminal, and an apparatus having a touch panel. The above-mentioned electro-optical device can be applied as display units of the above-mentioned various electronic apparatuses.

Further, the electro-optical device 1 can be applied to a writing head, such as an optical writing printer or electronic copier, in addition to the display units of various electronic apparatuses.

What is claimed is:

1. An electro-optical device comprising:

a plurality of data lines;

a plurality of scanning lines;

a plurality of pixel circuits that are arranged corresponding to intersections of the data lines and the scanning lines, each pixel circuit including:

an electro-optical element whose brightness is controlled by gray-scale signals supplied from the data lines;

a driving transistor that drives the electro-optical elements; and a light-emission control transistor that controls a light-emission period of the electro-optical elements based on a light-emission control signal; and a data line driving circuit connected to the data lines, the data line driving circuit including:

a D/A conversion circuit;

a bit shift circuit that switches, according to a control signal, whether input digital data constituted by a plurality of bits that regulate brightness of pixels is output as-is or whether the plurality of bits are bit-shifted to a lower side and are output;

a supply circuit that supplies output digital data of the bit shift circuit to the D/A conversion circuit; and a pseudo-halftone processing circuit that is provided between the bit shift circuit and the supply circuit to perform pseudo-halftone processing that pseudo-increases the number of gray-scale levels of the output digital data of the bit shift circuit, wherein the D/A conversion circuit supplies the gray-scale signals obtained by D/A converting the output digital data of the supply circuit to the data lines, and when the input digital data is bit-shifted to a lower side by the bit shift circuit, a light-emission period of the electro-optical elements is adjusted by controlling the light-emission control signal.

2. The electro-optical device as set forth in claim 1, wherein the pseudo-halftone processing circuit performs the pseudo-halftone processing on the output digital data of the bit shift circuit according to a dither method.

3. The electro-optical device as set forth in claim 1, wherein the pseudo-halftone processing means performs the pseudo-halftone processing on the output digital data of the bit shift means according an error diffusion method.

4. The electro-optical device as set forth in claim 1, wherein the data lines are constituted by a plurality of wiring lines, the D/A conversion circuit is provided with a plurality of D/A conversion sub-circuits corresponding to the plurality of wiring lines, respectively, and the supply circuit converts supplied digital data into a plurality of conversion data, respectively corresponding to the plurality of D/A conversion sub-circuits and outputs them to the D/A conversion circuit.

5. The electro-optical device as set forth in claim 4, wherein each pixel circuit includes three pixel sub-circuits that display colors of R, G, and B, and the input digital data is constituted by data indicating an R color gray-scale level, data indicating a G color gray-scale level, and data indicating a B color gray-scale level.

6. An electronic apparatus comprising the electro-optical device as set forth in claim 1.

* * * * *